US010549443B2

(12) United States Patent
McDonald et al.

(10) Patent No.: US 10,549,443 B2
(45) Date of Patent: Feb. 4, 2020

(54) ULTRASONIC CUTTING MACHINE WITH AUTOMATED BLADE CLEANING SYSTEM

(71) Applicant: The Boeing Company, Chicago, IL (US)

(72) Inventors: Emily E. McDonald, Charleston, SC (US); Amy E. Cooper, St. Louis, MO (US); Allen Halbritter, Charleston, SC (US); Meredith P. Nix, Charleston, SC (US); Kevin W. Kaufman, Charleston, SC (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/016,198

(22) Filed: Feb. 4, 2016

(65) Prior Publication Data

US 2017/0225349 A1 Aug. 10, 2017

(51) Int. Cl.

| | |
|---|---|
| ***B08B 3/10*** | (2006.01) |
| ***B26D 7/08*** | (2006.01) |
| ***B08B 3/08*** | (2006.01) |
| *B08B 1/00* | (2006.01) |

(52) U.S. Cl.

CPC ..... *B26D 7/088* (2013.01); *B08B 3/08* (2013.01); *B08B 3/10* (2013.01); *B26D 7/086* (2013.01); *B08B 1/002* (2013.01)

(58) Field of Classification Search

CPC .. B08B 3/08; B08B 3/10; B08B 3/102; B08B 3/12; B26D 7/12; B26D 7/086; B26D 7/088; B24D 15/06; B24D 15/10

USPC ..... 134/133, 200; 15/218, 218.1

See application file for complete search history.

(56) References Cited

U.S. PATENT DOCUMENTS 1,651,781 A * 12/1927 Sprague ..... B24D 15/085 451/316
2,439,646 A * 4/1948 Bostwick ..... B24D 15/087 451/205
4,087,878 A * 5/1978 Grieshaber ..... A61B 90/70 15/104.92
4,704,760 A * 11/1987 Grieshaber ..... A61B 90/70 15/218.1

(Continued)

FOREIGN PATENT DOCUMENTS

JP 2015089596 A * 5/2015

OTHER PUBLICATIONS

Machine translation of JP 2015089596 A, dated May 2015.*
European Patent Office, Extended European Search Report, EP 16 19 8825 (dated Jun. 2, 2017).

*Primary Examiner* — Michael E Barr
*Assistant Examiner* — Kevin G Lee
(74) *Attorney, Agent, or Firm* — Walters & Wasylyna LLC

(57) ABSTRACT

An ultrasonic cutting machine including a support structure, a positioning device moveable relative to the support structure, a cutting blade connected to the positioning device and a blade cleaning system positioned proximate the support structure, the blade cleaning system including a basin defining an internal volume and an opening into the internal volume, a solvent positioned in the internal volume, a cleaning surface positioned in the internal volume, wherein the cleaning surface is at least partially submerged in the solvent, and a lid positioned over the opening, wherein the lid is automatically displaced from the opening when the cutting blade approximates the basin.

20 Claims, 6 Drawing Sheets

(56) References Cited

U.S. PATENT DOCUMENTS

| | | | | |
|---|---|---|---|---|
| 4,752,983 | A * | 6/1988 | Grieshaber | A61B 90/70 15/160 |
| 4,890,348 | A * | 1/1990 | Racioppi | A45D 27/46 15/160 |
| 4,920,495 | A | 4/1990 | Pilkington | |
| 6,974,948 | B1 * | 12/2005 | Brent | B65F 1/1638 250/221 |
| 8,132,487 | B2 | 3/2012 | Evans et al. | |
| 2002/0164935 | A1 * | 11/2002 | Fletcher | B24B 3/48 451/293 |
| 2006/0174760 | A1 * | 8/2006 | Rentz | B23Q 3/069 92/33 |
| 2009/0127145 | A1 * | 5/2009 | Nonaka | B25J 15/0491 206/349 |
| 2011/0024418 | A1 * | 2/2011 | Batson | B65D 90/585 220/211 |
| 2011/0088526 | A1 * | 4/2011 | Nonaka | B25J 15/0491 83/168 |
| 2011/0230124 | A1 * | 9/2011 | Andersen | B24B 3/48 451/321 |
| 2014/0373452 | A1 * | 12/2014 | Yang | F16J 13/22 49/280 |

* cited by examiner

ULTRASONIC CUTTING MACHINE WITH AUTOMATED BLADE CLEANING SYSTEM

FIELD

This application relates to cutting machines, such as ultrasonic composite trimming machines, and, more particularly, to automated cleaning of the cutting blades of cutting machines.

BACKGROUND

Composite structures are typically formed by laying up multiple plies on a tool. Each ply may include a reinforcing material, such as carbon fiber, and may be pre-impregnated with a resin. Multiple plies are applied, one upon another, often in multiple directions, to form a layup. Excess composite material often must be cut from the layup, either before or after the layup is cured.

The cutting of a composite layup, particularly an uncured composite layup, can be difficult, particularly when a clean edge is desired. Therefore, ultrasonic cutting machines are typically employed when cutting composite layups. The use of ultrasonic energy (as compared to a purely mechanical cut) reduces the likelihood that the cutting blade will adhere to the layup and drag one or more plies out of position, particularly when the layup is relatively thick.

Over time, the cutting blade on an ultrasonic cutting machine can accumulate fiber and resin. Such a build-up of debris may impede cutting, and may cause reinforcing material to fray and/or pull from the plies, thereby compromising the quality of the resulting cured composite structure. Frequent replacement of ultrasonic cutting blades is one solution, but is expensive and time consuming. Frequent cleaning of ultrasonic cutting blades is another solution—it creates a higher quality cut and may extend cutting blade life.

Manual cleaning of cutting blades, while effective, presents safety issues and can be time consuming. Therefore, automated cutting blade cleaning has been explored. In one known example, ultrasonic cutting blades have been dipped into a basin of solvent, energized with ultrasonic energy while still submerged in the solvent, and then dried in air by again energizing the cutting blade. However, energizing ultrasonic cutting blades in a solvent presents various issues depending on the type of solvent used. If the solvent is an organic solvent, energizing an ultrasonic cutting blade in the solvent presents a potential fire hazard. Using water as a solvent eliminates the potential fire hazard, but water is often prohibited in composite fabrication facilities, and water is not a particularly effective solvent for composite resins.

Accordingly, those skilled in the art continue with research and development efforts in the field of ultrasonic cutting machine blade cleaning.

SUMMARY

In one embodiment, the disclosed ultrasonic cutting machine may include a cutting blade and a blade cleaning system, the blade cleaning system including a basin defining an internal volume and an opening into the internal volume, the internal volume being configured to receive therein a solvent, a cleaning surface positioned in the internal volume, and a lid positioned over the opening, wherein the lid is automatically displaced from the opening when the cutting blade approximates the basin.

In another embodiment, the disclosed ultrasonic cutting machine may include a positioning device, a cutting blade connected to the positioning device and a blade cleaning system positioned to be accessible to the cutting blade, the blade cleaning system including a basin defining an internal volume and an opening into the internal volume, a solvent positioned in the internal volume, a cleaning surface positioned in the internal volume, and a lid positioned over the opening, wherein the lid is automatically displaced from the opening when the cutting blade approximates the basin.

In another embodiment, the disclosed ultrasonic cutting machine may include a support structure, a positioning device moveable relative to the support structure, an ultrasonic cutting blade connected to the positioning device and a blade cleaning system connected to the support structure, the blade cleaning system including a basin defining an internal volume and an opening into the internal volume, the internal volume being configured to receive therein a solvent, a bristle brush positioned in the internal volume, a lid positioned over the opening, a twist clamp cylinder operatively connected to the lid, and a sensor defining a light curtain, wherein the twist clamp cylinder is actuated to displace the lid from the opening when the light curtain is broken.

In another embodiment, the disclosed ultrasonic cutting machine may include a support structure, a positioning device moveable relative to the support structure, an ultrasonic cutting blade connected to the positioning device and a blade cleaning system connected to the support structure, the blade cleaning system including a basin defining an internal volume and an opening into the internal volume, an organic solvent positioned in the internal volume, a bristle brush positioned in the internal volume, wherein the bristle brush is at least partially submerged in the organic solvent, a lid positioned over the opening, a twist clamp cylinder operatively connected to the lid, and a sensor defining a light curtain, wherein the twist clamp cylinder is actuated to displace the lid from the opening when the light curtain is broken.

In one embodiment, the disclosed method for cleaning a cutting blade of a cutting machine may include the steps of (1) moving the cutting blade toward a blade cleaning system that includes a basin defining an internal volume and an opening into the internal volume, a solvent positioned in the internal volume, a cleaning surface positioned in the internal volume, wherein the cleaning surface is at least partially submerged in the solvent, and a lid positioned over the opening; (2) automatically removing the lid from the opening when the cutting blade approximates the basin; (3) submerging, at least partially, the cutting blade into the solvent; (4) moving the cutting blade along the cleaning surface; (5) removing the cutting blade from the basin, wherein the lid automatically returns to the opening after the cutting blade is removed from the basin; and (6) drying the cutting blade.

Other embodiments of the disclosed ultrasonic cutting machine with automated blade cleaning system will become apparent from the following detailed description, the accompanying drawings and the appended claims.

DETAILED DESCRIPTION

Disclosed is a cutting machine, such as an ultrasonic cutting machine, provided with a blade cleaning system located in relatively close proximity to the cutting machine, and automatically accessible to the cutting blade of the cutting machine. The blade cleaning system may employ at least two cleaning modes: (1) a solvent for chemically treating (e.g., solubilizing) debris, such as resin, on the cutting blade and (2) a cleaning surface for physically treating (e.g., agitating) debris on the cutting blade. Both the cleaning surface and the solvent of the blade cleaning system may be contained within a basin such that the cleaning surface may be at least partially submerged in the solvent. A lid may normally cover the basin, thereby reducing (if not eliminating) flash-off of solvent while the blade cleaning system is not in use. However, the lid may be automatically displaced from the basin when the cutting blade approximates the basin for cleaning.

Figure 1:
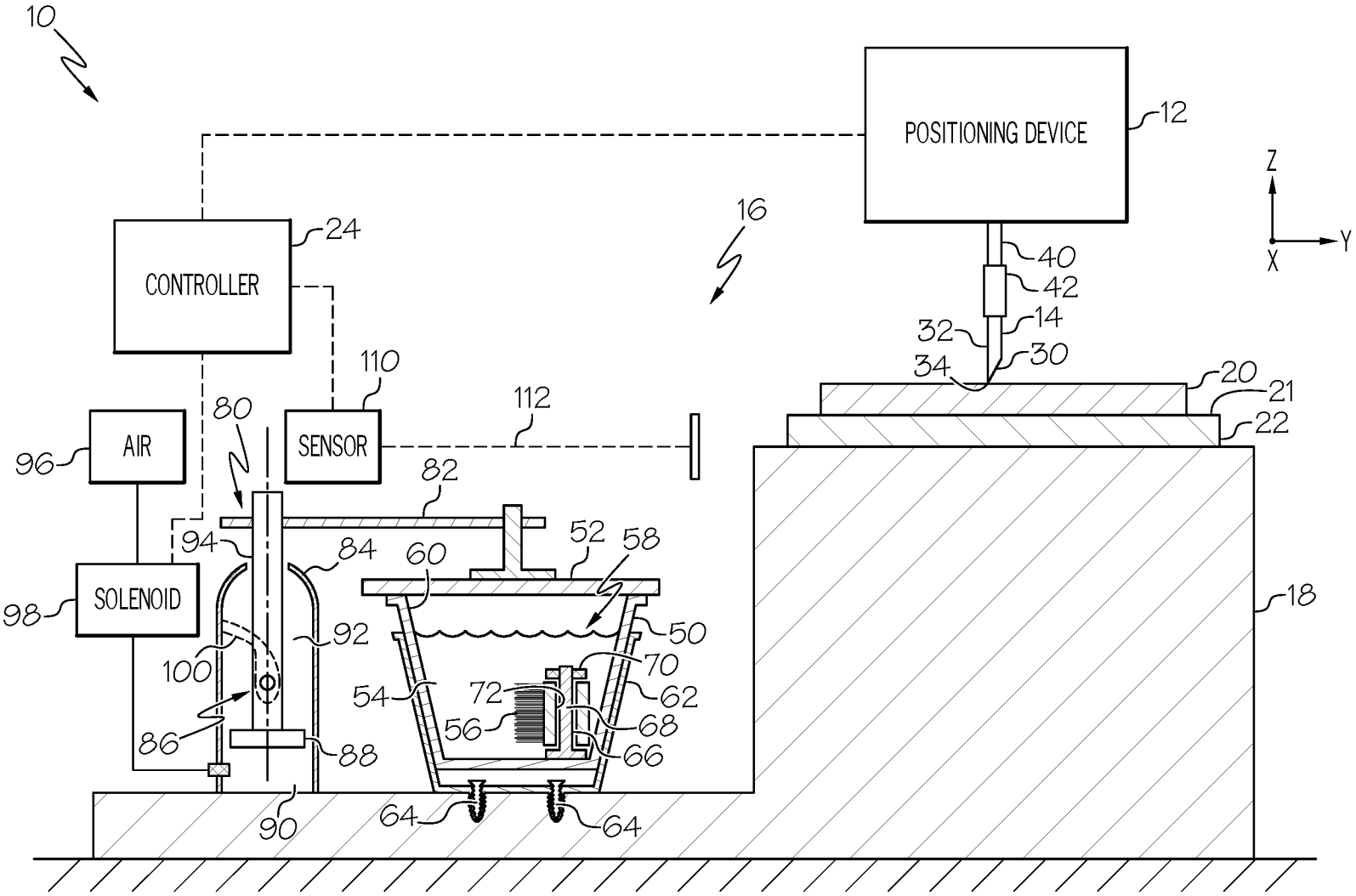
FIG. 1 is an elevational view, partially in section, of one embodiment of the disclosed ultrasonic cutting machine with automated blade cleaning system.

Referring to FIG. 1, one embodiment of the disclosed cutting machine, generally designated 10, may include a positioning device 12, a cutting blade 14 connected to and moveable with the positioning device 12, and a blade cleaning system 16. The cutting machine 10 may further include a support structure 18 for supporting a workpiece 20 (e.g., a composite layup) on a work surface 21, such as on a tool 22. The positioning device 12 may move the cutting blade 14 relative to the workpiece 20 to cut the workpiece 20 as desired. The positioning device 12 may also move the cutting blade 14 to the blade cleaning system 16 for cleaning, as is described in greater detail herein.

The positioning device 12 may be controlled by a controller 24, such as a computer. The positioning device 12 may receive commands from the controller 24 and may position/move the cutting blade 14 accordingly. Therefore, the positioning device 12 may be (or may include) any apparatus or system capable of positioning the cutting blade 14 along and/or about one or more axes, thereby positioning the cutting blade 14 relative to the workpiece 20, as well as relative to the blade cleaning system 16, as commanded. As one non-limiting example, the positioning device 12 may be (or may include) a robotic arm. As another non-limiting example, the positioning device 12 may be (or may include) an x-y table. As yet another non-limiting example, the positioning device 12 may be (or may include) a gantry.

In one particular construction, the positioning device 12 may be a six-axis positioning device. Therefore, the positioning device 12 may be capable of positioning the cutting blade 14 along the x-axis, about the x-axis, along the y-axis, about the y-axis, along the z-axis and about the z-axis.

The cutting blade 14 may be connected to, and moveable with, the positioning device 12. The cutting blade 14 may be any apparatus capable of cutting, or at least scoring, the workpiece 20. In one specific construction, the cutting blade 14 may be sharpened, and may include a first surface 30 intersecting a second surface 32 at (or along) a cutting edge 34. When in use, the cutting edge 34, the first surface 30 and/or the second surface 32 may collect debris (e.g., resin) and, therefore, may require cleaning.

Cutting blades 14 of various shapes, configurations and compositions may be used in the disclosed cutting machine 10 without departing from the scope of the present disclosure. In one specific, non-limiting example, the cutting blade 14 may be a ceramic blade, such as a carbide (e.g., silicon carbide) blade. As another specific, non-limiting example, the cutting blade 14 may be a metallic blade, such as a stainless steel blade.

The cutting machine 10 may be an ultrasonic cutting machine. Therefore, the cutting blade 14 may be an ultrasonic cutting blade, and the cutting machine 10 may further include an ultrasound transducer 40 and a waveguide 42. The waveguide 42 may acoustically couple the ultrasound transducer 40 with the cutting blade 14 such that the cutting blade 14 may be energized by the ultrasound transducer 40 during a cutting operation.

While an ultrasonic cutting machine is shown and described, those skilled in the art will appreciate that the disclosed blade cleaning system 16 may be used with non-ultrasonic cutting machines. In one alternative embodiment, the disclosed blade cleaning system 16 may be used with a cutting machine that energizes the cutting blade 14 with thermal energy. In another alternative embodiment, the disclosed blade cleaning system 16 may be used with a cutting machine that employs a purely mechanical cutting blade 14 (no energizing of the cutting blade 14).

The blade cleaning system 16 may include a basin 50, a lid 52, a solvent 54 and a cleaning surface 56. The basin 50 may define an internal volume 58 and an opening 60 into the internal volume 58. The solvent 54 and the cleaning surface 56 may be contained in the internal volume 58 of the basin 50. The lid 52 may be positioned over the opening 60 of the basin 50, thereby sealing (at least partially) the opening 60 and reducing (if not eliminating) flash-off of the solvent 54 when the blade cleaning system 16 is not in use. However, the lid 52 may be automatically displaced from the opening 60 when the cutting blade 14 approximates the basin 50 for cleaning.

The basin 50 may be any vessel capable of containing the solvent 54 and the cleaning surface 56. The composition of the basin 50 may be such that the solvent 54 does not dissolve or react with the basin 50. Furthermore, the basin 50 may be sufficiently rigid, yet impact resistant. For example, the basin 50 may be a pan, bucket or the like formed from a metallic material, such as stainless steel.

The blade cleaning system 16 may be positioned in relatively close proximity to the work surface 21 of the cutting machine 10 such that the blade cleaning system 16 is quickly and easily accessible to the cutting blade 14. In one particular configuration, the basin 50 of the blade cleaning system 16 may be connected to the support structure 18 of the cutting machine 10. For example, an outer containment vessel 62 may be fixedly connected to the support structure 18, such as with mechanical fasteners 64 (e.g., bolts). Then, the basin 50 may be nested within the outer containment vessel 62, thereby facilitating proper location of the basin 50, while inhibiting undesired movement of the basin 50 vis-à-vis the support structure 18.

The solvent 54 may occupy at least a portion of the internal volume 58 of the basin 50. In one expression, the volume of solvent 54 in the basin 50 may be at least 10 percent of the internal volume 58. In another expression, the volume of solvent 54 in the basin 50 may be at least 20 percent of the internal volume 58. In another expression, the volume of solvent 54 in the basin 50 may be at least 40 percent of the internal volume 58. In another expression, the volume of solvent 54 in the basin 50 may be at least 50 percent of the internal volume 58. In another expression, the volume of solvent 54 in the basin 50 may be at least 60 percent of the internal volume 58. In another expression, the volume of solvent 54 in the basin 50 may be at least 70 percent of the internal volume 58. In yet another expression, the volume of solvent 54 in the basin 50 may be at least 80 percent of the internal volume 58.

Various solvents 54 may be used in the blade cleaning system 16 without departing from the scope of the present disclosure. Those skilled in the art will appreciate that the composition of the solvent 54 may depend, at least in part, on the composition of the workpiece 20 being processed by the cutting blade 14. When the workpiece 20 is a composite layup comprising resin and reinforcing material, the solvent 54 may be an organic solvent, such as, but not limited to, acetone, methyl ethyl ketone, alcohol (e.g., methyl alcohol), benzene, turpentine, tetrahydrofuran and various mixtures thereof. The solvent 54 may alternatively be inorganic, such as water.

The cleaning surface 56 may be positioned in the internal volume 58 of the basin 50, and may be at least partially submerged in the solvent 54. The cleaning surface 56 may be fixedly connected to the basin 50, such as with one or more mechanical fasteners 66, such that the cleaning surface 56 does not move relative to the basin 50 during a cleaning operation. For example, the mechanical fastener 66 may include a bolt 68 and a nut 70, wherein the bolt 68 is fixedly connected to the basin 50 (e.g., welded) and extends through a bore 72 in the cleaning surface 56, and the nut 70 secures the cleaning surface 56 to the bolt 68.

As shown in FIG. 1, the cleaning surface 56 may be (or may include) a bristle brush. However, various other cleaning surfaces 56 may be used within the basin 50 of the blade cleaning system 16 to facilitate physically treating (e.g., agitating) debris on the cutting blade 14. As one alternative example, the cleaning surface 56 may be (or may include) a sponge. As another alternative example, the cleaning surface 56 may be (or may include) a scouring pad. As another alternative example, the cleaning surface 56 may be (or may include) an abrasive material (e.g., sandpaper). As yet another alternative example, the cleaning surface 56 may be (or may include) a textured surface on the inner surface of the basin 50.

While a single cleaning surface 56 (e.g., bristle brush) is shown in the drawings, two or more cleaning surfaces 56 may be positioned in the internal volume 58 of the basin 50, and may be at least partially submerged in the solvent 54, without departing from the scope of the present disclosure. For example, a second cleaning surface (not shown) may be opposed from the cleaning surface 56 shown in FIG. 1 (e.g., in a generally parallel configuration) such that, during a cleaning operation, the cutting blade 14 may be moved between and contacted by both cleaning surfaces 56.

As noted above, the lid 52 may be normally positioned over the opening 60 of the basin 50 to reduce (if not eliminate) flash-off of the solvent 54 when the blade cleaning system 16 is not in use. However, the lid 52 may be automatically displaced from the opening 60 when the positioning device 12 approximates the cutting blade 14 with the basin 50, thereby providing the cutting blade 14 access to the blade cleaning system 16.

Figure 2A:
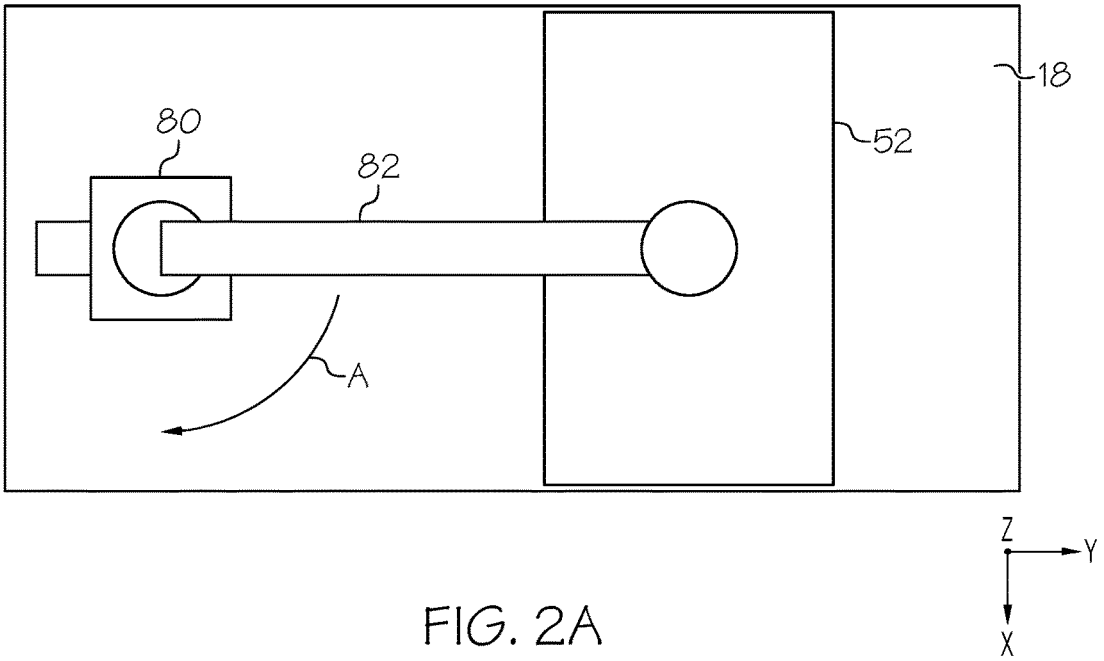
FIG. 2A is a plan view of the blade cleaning system of the ultrasonic cutting machine of FIG. 1.
Figure 2B:
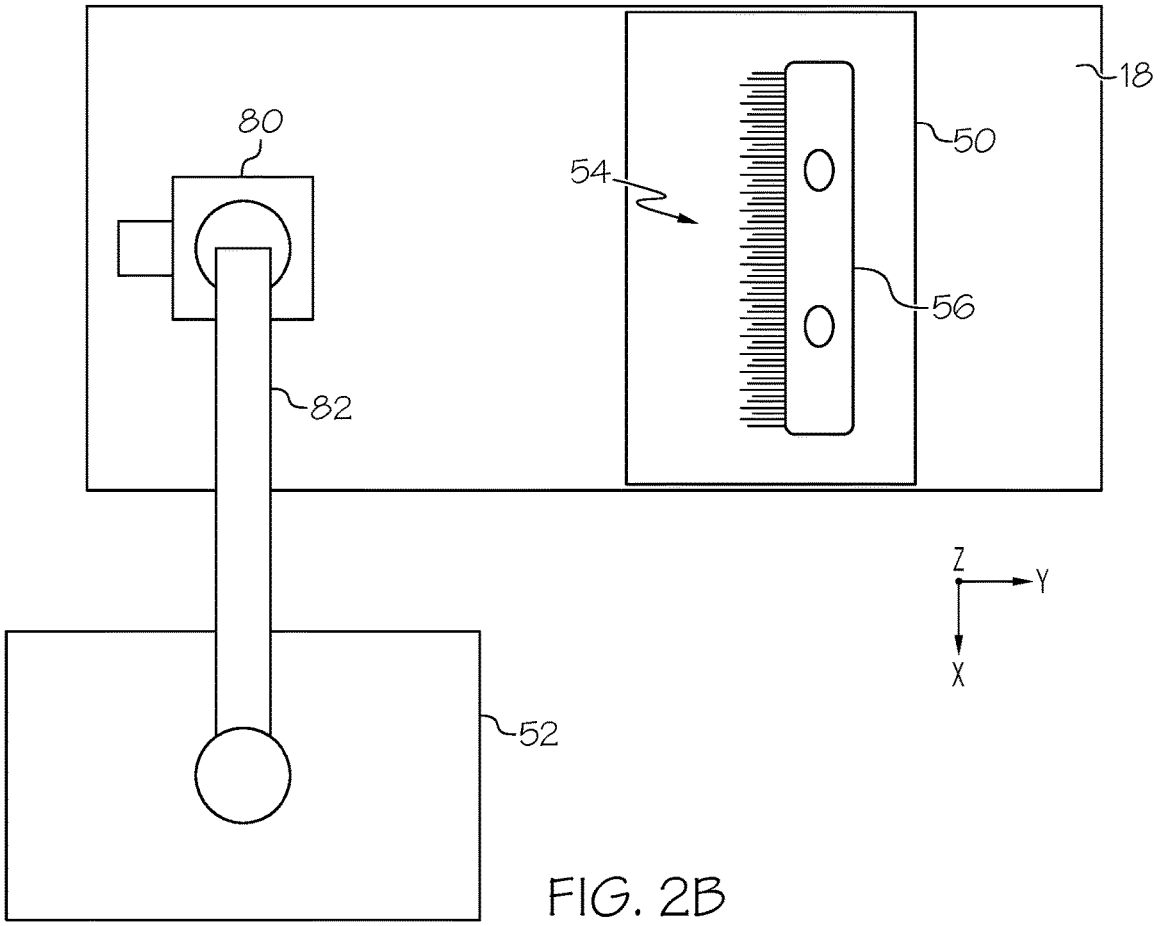
FIG. 2B is a plan view of the blade cleaning system of FIG. 2A, but shown in an open configuration.

A twist clamp cylinder 80 may be connected to the lid 52 by way of an arm 82. When actuated, the twist clamp cylinder 80 may lift the lid 52 from the basin 50 and, as shown in FIGS. 2A and 2B, may swing (arrow A in FIG. 2A) the lid 52 away from the basin 50 (e.g., about ninety degrees), thereby exposing the solvent 54 and cleaning surface 56 within the basin 50.

Still referring to FIG. 1, the twist clamp cylinder 80 may be pneumatically actuated, though other actuation modes (e.g., hydraulic and electric) are also contemplated. For example, the twist clamp cylinder 80 may include a housing 84 defining a volume 86, and a piston 88 closely and sideably received within the housing 84 to divide the volume 86 into a piston chamber 90 and a rod chamber 92. A rod 94 may extend from the piston 88, though the rod chamber 92, and may be connected to the arm 82, which in turn may be connected to the lid 52. A compressed air source 96 may be in selective fluid communication with the piston chamber 90 by way of a solenoid valve 98. When the solenoid valve 98 is opened (e.g., per a command received from the controller 24), the compressed air source 96 may pressurize the piston chamber 90, thereby moving the piston 88 and urging the rod 94 outward from the housing 84 along a rod axis R. However, the rod 94 may be engaged with a track 100 in the housing 84. Therefore, as the rod 94 axially extends along the rod axis R, the engagement with the track 100 may cause the rod 94 to twist about the rod axis R, thereby causing corresponding lifting of the lid 52 from the basin 50 and twisting (arrow A in FIG. 2A) of the lid 52 away from the basin 50.

While a twist clamp cylinder 80 is a suitable technique for automatically displacing the lid 52 from the basin 50, various other techniques for automatically displacing the lid 52 from the basin 50 may be used without departing from the scope of the present disclosure. Alternative techniques (to the twist clamp cylinder 80) include, without limitation, use of a robotic arm, use of a twisting mechanism (twist only; no lifting), use of a lever mechanism, and use of a hinged connection between the lid 52 and the basin 50.

Before the lid 52 is displaced from the opening 60 of the basin 50, a determination may be made that the cutting blade 14 is approximating the basin 50 for cleaning. Once such a determination has been made, the solenoid valve 98 may be actuated to displace the lid 52 from the basin 50.

In one aspect, the determination that the cutting blade 14 is approximating the basin 50 for cleaning may be made by the controller 24 (e.g., written in software executed by the controller 24). For example, the software operating the positioning device 12 may include a provision for positioning the cutting blade 14 in the basin 50 for cleaning. Therefore, such software may also include a provision for actuating the solenoid valve 98 to displace the lid 52 from the basin 50 in conjunction with positioning the cutting blade 14 in the basin 50 for cleaning.

In another aspect, a sensor 110 may determine that the cutting blade 14 is approximating the basin 50 for cleaning. As shown in FIG. 1, one or more sensors 110 may be positioned proximate the basin 50 to detect the presence of the cutting blade 14. Various presence detection devices may be used as the sensor 110. As one specific, non-limiting example, the sensor 110 may define a light curtain 112, and may detect if/when the light curtain 112 is broken, which may be indicative of the cutting blade 14 approximating the basin 50. The sensor 110 may be in communication with the controller 24 such that, when the sensor detects the light curtain 112 being broken, the controller 24 may actuate the solenoid valve 98 to effect displacement of the lid 52 from the basin 50. As one alternative example, the sensor 110 may be a motion sensor or the like.

Figure 3:
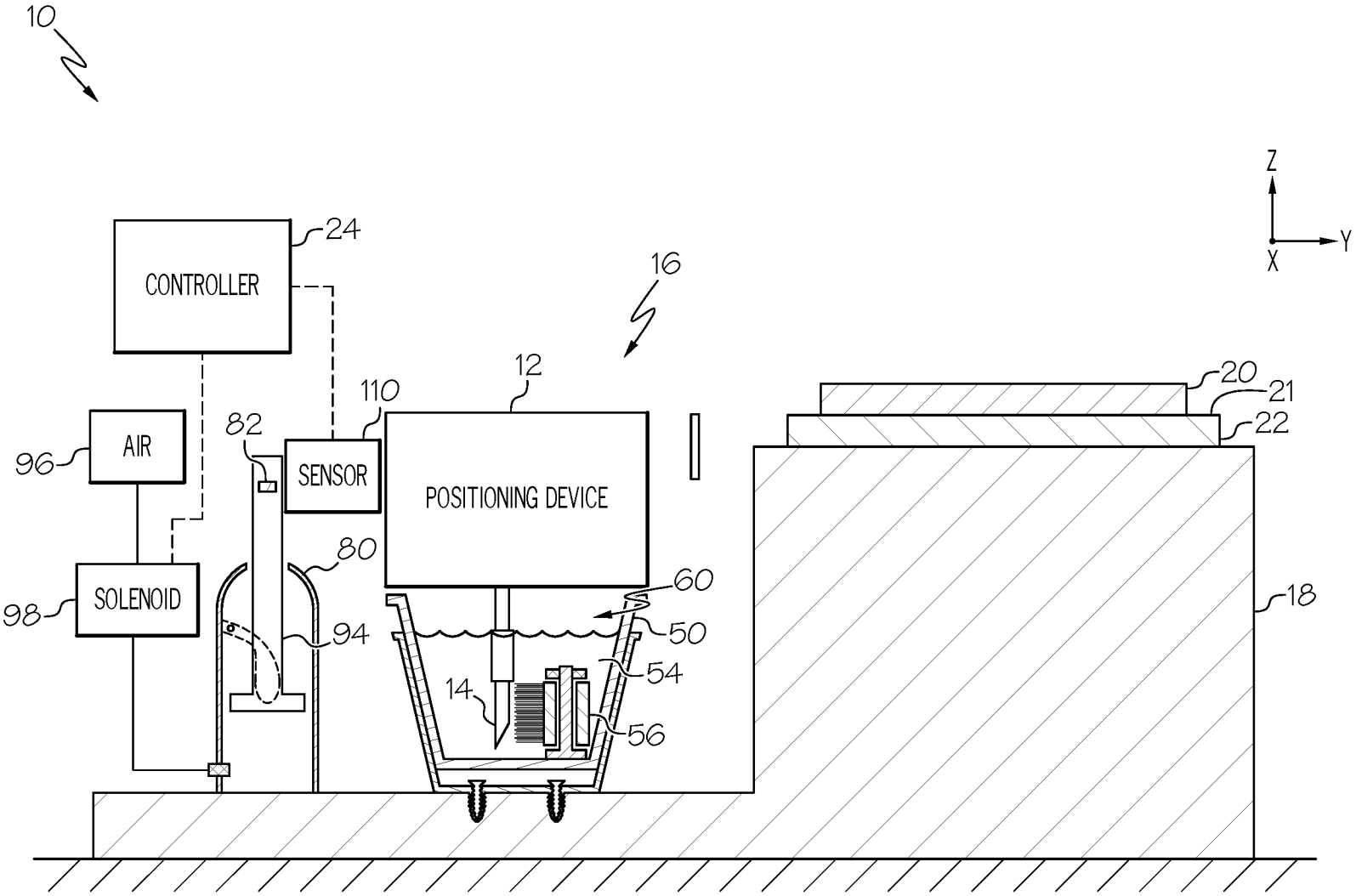
FIG. 3 is an elevational view, partially in section, of the ultrasonic cutting machine of FIG. 1 shown cleaning a cutting blade.

Referring now to FIG. 3, once the lid 52 has been displaced from the opening 60 of the basin 50, the positioning device 12 may position the cutting blade 14 in contact with both the solvent 54 and the cleaning surface 56. Therefore, the solvent 54 may chemically treat (e.g., solubilize) debris on the cutting blade 14, while the cleaning surface 56 may physically treat (e.g., agitate) debris on the cutting blade 14.

Figure 4A:
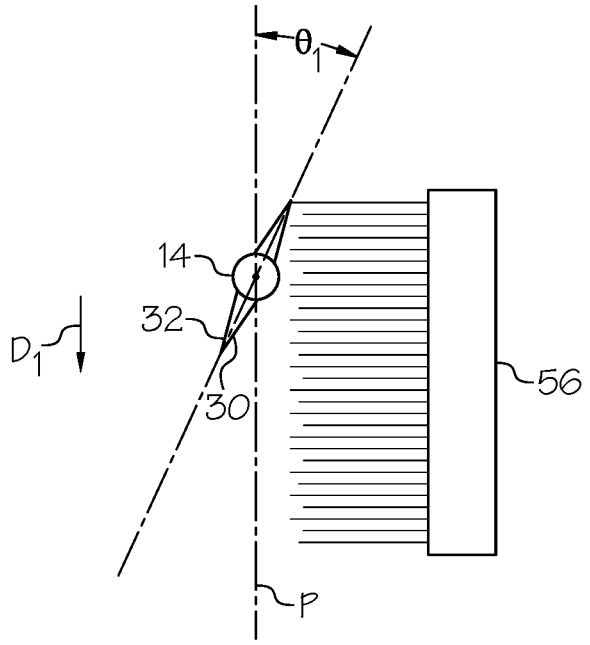
FIG. 4A is a plan view of the cutting blade of FIG. 3 moving in a first direction relative to a cleaning surface of the disclosed blade cleaning system.
Figure 4B:
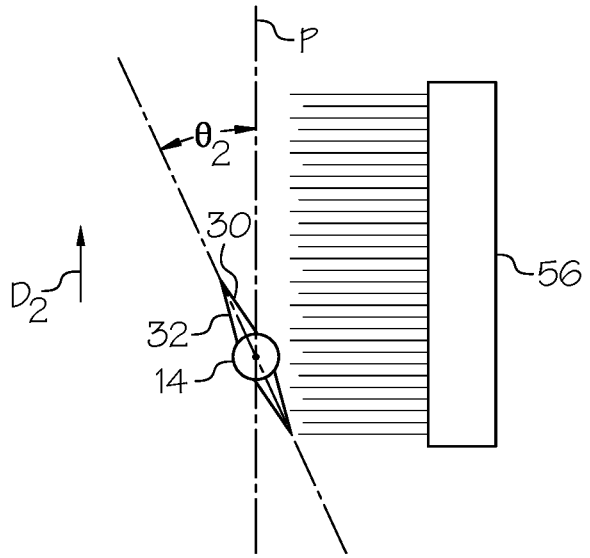
FIG. 4B is a plan view of the cutting blade of FIG. 4A moving in a second (opposite) direction relative to the cleaning surface.

As shown in FIGS. 4A and 4B, the positioning device 12 may move the cutting blade 14 in a travel path P along the cleaning surface 56 such that the cleaning surface 56 engages the cutting blade 14. The travel path P may be substantially linear and aligned with (e.g., parallel with) the cleaning surface 56 or, alternatively, may be non-linear. With the first surface 30 engaged with the cleaning surface 56, the cutting blade 14 may move in a first direction $D_1$ (FIG. 4A) along the travel path P, and then may return in a second direction $D_2$ (FIG. 4B) along the travel path P. Then, while not shown in the drawings, the cutting blade 14 may be flipped 180 degrees such that the second surface 32 is engaged with the cleaning surface 56, and movement along the travel path P (in the first and second directions $D_1$, $D_2$) may be repeated.

Still referring to FIGS. 4A and 4B, to promote contact with the cleaning surface 56 while minimizing damage (e.g., cutting) of the cleaning surface 56, the cutting blade 14 may be oriented at an angle $\Theta_1$, $\Theta_2$ relative to the travel path P as the cutting blade 14 moves along the travel path P. Specifically, the cutting blade 14 may be oriented at angle $\Theta_1$ relative to the travel path P as the cutting blade 14 moves in the first direction $D_1$, and then may be oriented at angle $\Theta_2$ relative to the travel path P as the cutting blade 14 moves in the second direction $D_2$.

The angles $\Theta_1$, $\Theta_2$ may be non-zero angles. In one expression, the angles $\Theta_1$, $\Theta_2$ may range from about 1 degree to about 45 degrees. In another expression, the angles $\Theta_1$, $\Theta_2$ may range from about 4 degrees to about 20 degrees. In another expression, the angles $\Theta_1$, $\Theta_2$ may range from about 5 degrees to about 15 degrees. In yet another expression, the angles $\Theta_1$, $\Theta_2$ may be about 10 degrees.

In one alternative embodiment, rather than the cutting machine 10 including a positioning device 12 that moves the cutting blade 14 relative to a stationary blade cleaning system 16, instead the cutting blade 14 may be stationary. The positioning device 12 may then move the blade cleaning system 16 relative to the stationary cutting blade 14.

Also disclosed is a method for cleaning a cutting blade of a cutting machine, such as an ultrasonic cutting machine. The method may employ a blade cleaning system located in relatively close proximity to the cutting machine, and automatically accessible to the cutting blade of the cutting machine. The blade cleaning system may include a solvent for chemically treating (e.g., solubilizing) debris on the cutting blade and a cleaning surface for physically treating (e.g., agitating) debris on the cutting blade. Both the cleaning surface and the solvent of the blade cleaning system may be contained within a basin such that the cleaning surface may be at least partially submerged in the solvent. A lid may normally cover the basin, thereby reducing (if not eliminating) flash-off of solvent while the blade cleaning system is not in use. However, the lid may be automatically displaced from the basin when the cutting blade approximates the basin for cleaning.

Figure 5:
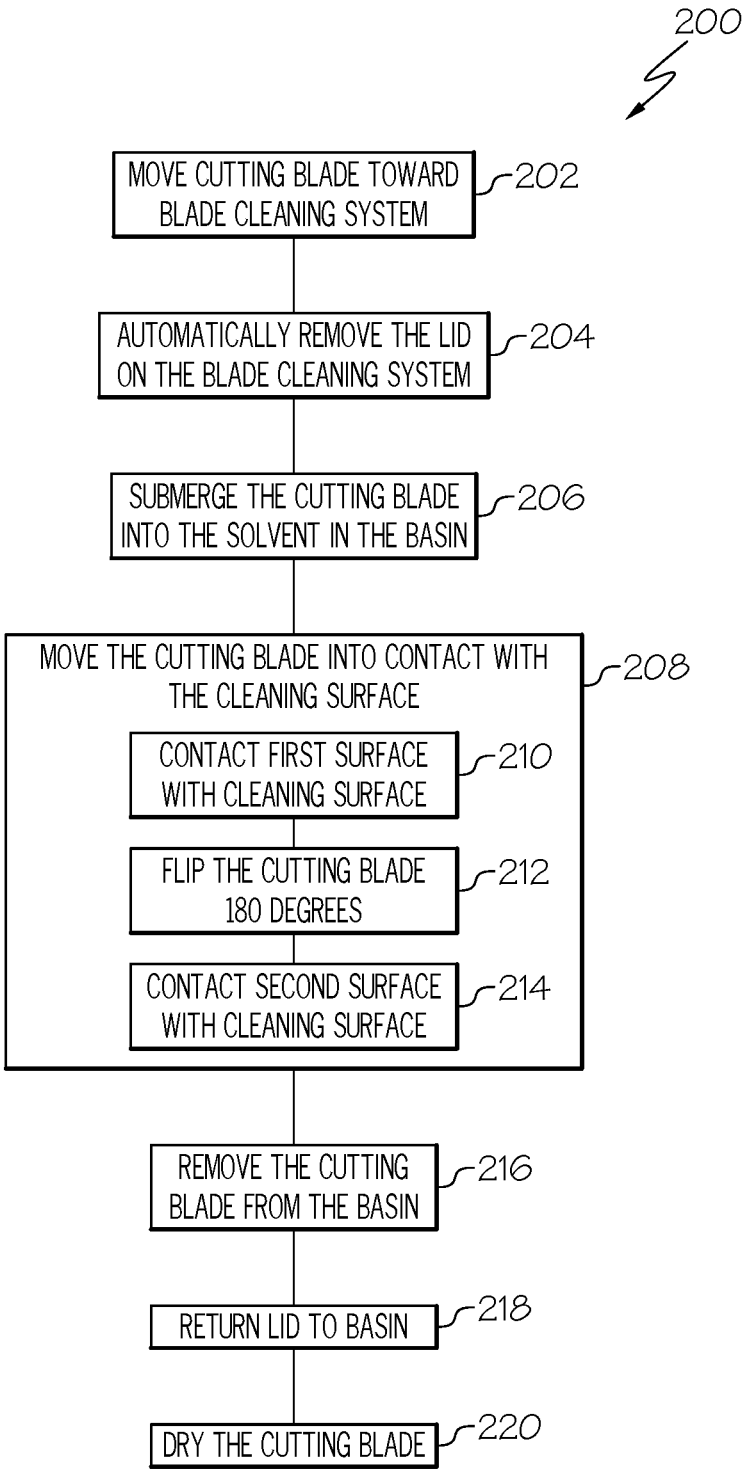
FIG. 5 is a flow diagram of one embodiment of the disclosed method for cleaning the cutting blade of an ultrasonic cutting machine.

Referring to FIG. 5, one embodiment of the disclosed method for cleaning a cutting blade of a cutting machine, generally designated 200, may begin at Block 202 with the step of moving the cutting blade toward a blade cleaning system. The blade cleaning system 16 may include a basin 50 defining an internal volume 58 and an opening 60 into the internal volume 58, a solvent 54 positioned in the internal volume 58, a cleaning surface 56 positioned in the internal volume 58, wherein the cleaning surface 56 is at least partially submerged in the solvent 54, and a lid 52 positioned over the opening 60.

At Block 204, the lid 52 may be automatically removed from the opening 60 when the cutting blade 14 approximates said basin 50. For example, a twist clamp cylinder 80 may be actuated when a sensor 110 detects that the cutting blade 14 has broken a light curtain 112 defined by the sensor 110.

At Block 206, the cutting blade 14 may be submerged, at least partially, in the solvent 54. Therefore, the solvent 54 may chemically treat (e.g., solubilize) debris on the cutting blade 14.

At Block 208, the cutting blade 14 may be moved along the cleaning surface 56. Optionally, the cutting blade 14 may be oriented at an angle $\Theta_1$, $\Theta_2$ relative to the travel path P as the cutting blade 14 moves along the cleaning surface 56. Therefore, the cleaning surface 56 may physically treat (e.g., agitate) debris on the cutting blade 14. For example, as shown at Block 210, the first surface 30 of the cutting blade 14 may initially engage the cleaning surface 56. At Block 212, the cutting blade 14 may be flipped (e.g., 180 degrees). Then, at Block 214, the second surface 32 of the cutting blade 14 may engage the cleaning surface 56.

At this point, those skilled in the art will appreciate that the steps of Blocks 206 and 208 may be performed simultaneously.

At Block 216, the cutting blade 14 may be removed from the basin 50.

At Block 218, upon removal of the cutting blade 14 from the basin 50, the lid 52 may automatically return to its normal position over the opening 60 of the basin 50. For example, when the sensor 110 no longer detects a break in the light curtain 112, the solenoid valve 98 may be deactuated, thereby returning the lid 52 to its normal covering position.

At Block 220, the cutting blade 14 may be dried. One example technique for drying the cutting blade 14 may include energizing the cutting blade 14 in ambient air. When the cutting blade 14 is an ultrasonic cutting blade, the drying step (Block 212) may include actuating the ultrasound transducer 40 to supply ultrasonic energy to the cutting blade 14. Another example technique for drying the cutting blade 14 is air drying.

Accordingly, the disclosed cutting machine 10 and method 200 provide for automated cleaning of a cutting blade using at least two cleaning modes: chemical treatment for solubilizing debris and physical treatment for agitating debris. As such, cleaning times are reduced and cutting blade life is prolonged, thereby enhancing the operating efficiency of cutting machines.

Figure 6:
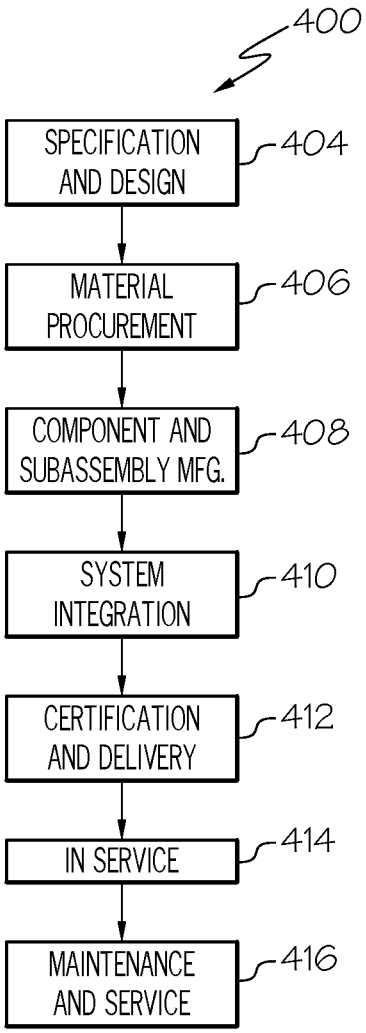
FIG. 6 is flow diagram of an aircraft manufacturing and service methodology.
Figure 7:
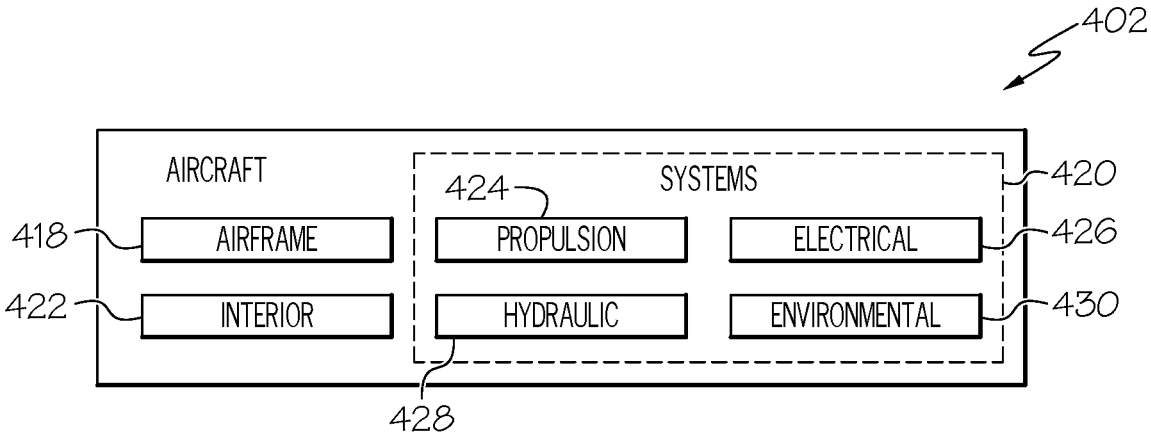
FIG. 7 is a block diagram of an aircraft.

Examples of the disclosure may be described in the context of an aircraft manufacturing and service method 400, as shown in FIG. 6, and an aircraft 402, as shown in FIG. 7. During pre-production, the aircraft manufacturing and service method 400 may include specification and design 404 of the aircraft 402 and material procurement 406.

During production, component/subassembly manufacturing 408 and system integration 410 of the aircraft 402 takes place. Thereafter, the aircraft 402 may go through certification and delivery 412 in order to be placed in service 414. While in service by a customer, the aircraft 402 is scheduled for routine maintenance and service 416, which may also include modification, reconfiguration, refurbishment and the like.

Each of the processes of method 400 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 7, the aircraft 402 produced by example method 400 may include an airframe 418 with a plurality of systems 420 and an interior 422. Examples of the plurality of systems 420 may include one or more of a propulsion system 424, an electrical system 426, a hydraulic system 428, and an environmental system 430. Any number of other systems may be included.

The disclosed ultrasonic cutting machine with automated blade cleaning system may be employed during any one or more of the stages of the aircraft manufacturing and service method 400. As one example, the disclosed ultrasonic cutting machine with automated blade cleaning system may be employed during material procurement 406. As another example, components or subassemblies corresponding to component/subassembly manufacturing 408, system integration 410, and or maintenance and service 416 may be fabricated or manufactured using the disclosed ultrasonic cutting machine with automated blade cleaning system. As another example, the airframe 418 and the interior 422 may be constructed using the disclosed ultrasonic cutting machine with automated blade cleaning system. Also, one or more apparatus examples, method examples, or a combination thereof may be utilized during component/subassembly manufacturing 408 and/or system integration 410, for example, by substantially expediting assembly of or reducing the cost of an aircraft 402, such as the airframe 418 and/or the interior 422. Similarly, one or more of system examples, method examples, or a combination thereof may be utilized while the aircraft 402 is in service, for example and without limitation, to maintenance and service 416.

The disclosed ultrasonic cutting machine with automated blade cleaning system is described in the context of an aircraft; however, one of ordinary skill in the art will readily recognize that the disclosed ultrasonic cutting machine with automated blade cleaning system may be utilized for a variety of applications. For example, the disclosed ultrasonic cutting machine with automated blade cleaning system may be implemented in various types of vehicles including, e.g., helicopters, passenger ships, automobiles and the like, as well as in non-vehicle applications (e.g., sports equipment manufacturing).

Although various embodiments of the disclosed ultrasonic cutting machine with automated blade cleaning system have been shown and described, modifications may occur to those skilled in the art upon reading the specification. The present application includes such modifications and is limited only by the scope of the claims.

What is claimed is:

1. A cutting machine comprising:

a cutting blade, wherein said cutting blade includes a first surface intersecting a second surface at a cutting edge;

a support structure for supporting a workpiece to be cut by said cutting blade;

a positioning device connected to said cutting blade, said positioning device being capable of positioning the cutting blade along an x-axis, about the x-axis, along a y-axis, about the y-axis, along a z-axis and about the z-axis;

a basin defining an internal volume and an opening into said internal volume, wherein said basin is configured to receive a solvent in said internal volume; and a cleaning surface positioned in said internal volume, said cleaning surface being an outermost surface area for physically agitating debris on the cutting blade, wherein said cleaning surface is fixed relative to said support structure;

a lid positioned over the opening of the basin, thereby at least partially sealing the opening of the basin;

a housing defining a volume;

a piston within the housing to divide the volume of the housing into a piston chamber and a rod chamber;

a rod extended from the piston though the rod chamber and connected to the lid by way of an arm disposed between the rod and the lid, wherein the rod is engaged with a track in the housing such that as the rod axially extends along a rod axis, the engagement with the track causes the rod to twist about the rod axis, thereby causing corresponding lifting of the lid from the basin and twisting of the lid away from the basin;

a compressed air source in selective fluid communication with the piston chamber by way of a solenoid valve, wherein when the solenoid valve is opened, the compressed air source pressurizes the piston chamber, thereby moving the piston and urging the rod to axially extend outward from the housing along the rod axis; and a controller communicatively coupled to the positioning device and to the solenoid valve, wherein the controller is configured to command said positioning device to move said cutting blade to cut said workpiece, to move said cutting blade to said basin, to open the solenoid value when the ultrasonic cutting blade is moved to the basin, and to orient said cutting blade at a first non-zero angle relative to a travel path such that said cutting edge of said cutting blade is aligned opposite to said travel path, and to move said cutting blade in said travel path while oriented at said first non-zero angle and while said cleaning surface physically agitates debris along said first surface and said cutting edge of said cutting blade.

2. The cutting machine of claim 1 wherein said controller is configured to move said cutting blade in said travel path while said first surface is in contact with said cleaning surface, then to turn said cutting blade relative to said cleaning surface, and then to move said cutting blade in said travel path while said second surface is in contact with said cleaning surface.

3. The cutting machine of claim 1 wherein the positioning device is a six-axis positioning device.

4. The cutting machine of claim 3 wherein the six-axis positioning device is a robotic arm.

5. The cutting machine of claim 1 wherein said support structure comprises a work surface on which the workpiece is positioned, and wherein said cleaning surface is fixed relative to said work surface.

6. The cutting machine of claim 1 wherein the cleaning surface comprises a bristle brush.

7. The cutting machine of claim 1 wherein the basin is fixedly connected to said support surface.

8. The cutting machine of claim 1 wherein the basin is fixedly connected to said support surface by one or more mechanical fasteners.

9. The cutting machine of claim 1 wherein the cleaning surface is fixedly connected to the basin.

10. The cutting machine of claim 1 wherein the cleaning surface is fixedly connected to the basin by one or more mechanical fasteners.

11. An ultrasonic cutting machine comprising:

an ultrasonic cutting blade, wherein said cutting blade includes a first surface intersecting a second surface at a cutting edge;

an ultrasound transducer;

a waveguide acoustically coupling the ultrasound transducer with the ultrasonic cutting blade;

a support structure for supporting a workpiece to be cut by said cutting blade;

a positioning device connected to said cutting blade, said positioning device being capable of positioning the cutting blade along an x-axis, about the x-axis, along a y-axis, about the y-axis, along a z-axis and about the z-axis;

a basin defining an internal volume and an opening into said internal volume, wherein said basin is configured to receive a solvent in said internal volume; and a cleaning surface positioned in said internal volume, said cleaning surface being an outermost surface area for physically agitating debris on the cutting blade, wherein said cleaning surface is fixed relative to said support structure;

a lid positioned over the opening of the basin, thereby at least partially sealing the opening of the basin;

a housing defining a volume;

a piston within the housing to divide the volume of the housing into a piston chamber and a rod chamber;

a rod extended from the piston though the rod chamber and connected to the lid by way of an arm disposed between the rod and the lid, wherein the rod is engaged with a track in the housing such that as the rod axially extends along a rod axis, the engagement with the track causes the rod to twist about the rod axis, thereby causing corresponding lifting of the lid from the basin and twisting of the lid away from the basin;

a compressed air source in selective fluid communication with the piston chamber by way of a solenoid valve, wherein when the solenoid valve is opened, the compressed air source pressurizes the piston chamber, thereby moving the piston and urging the rod to axially extend outward from the housing along the rod axis; and a controller communicatively coupled to the positioning device and to the solenoid valve, wherein the controller is configured to command said positioning device to move said cutting blade to cut said workpiece, to move said cutting blade to said basin, to open the solenoid value when the ultrasonic cutting blade is moved to the basin, and to orient said cutting blade at a first non-zero angle relative to a travel path such that said cutting edge of said cutting blade is aligned opposite to said travel path, and to move said cutting blade in said travel path while oriented at said first non-zero angle and while said cleaning surface physically agitates debris along said first surface and said cutting edge of said cutting blade.

12. The ultrasonic cutting machine of claim 11 wherein said controller is configured to move said cutting blade in said travel path while said first surface is in contact with said cleaning surface, then to turn said cutting blade relative to said cleaning surface, and then to move said cutting blade in said travel path while said second surface is in contact with said cleaning surface.

13. The ultrasonic cutting machine of claim 11 wherein the positioning device is a six-axis positioning device.

14. The ultrasonic cutting machine of claim 13 wherein the six-axis positioning device is a robotic arm.

15. The ultrasonic cutting machine of claim 11 wherein said support structure comprises a work surface on which the workpiece is positioned, and wherein said cleaning surface is fixed relative to said work surface.

16. The ultrasonic cutting machine of claim 11 wherein the cleaning surface comprises a bristle brush.

17. The ultrasonic cutting machine of claim 11 wherein the basin is fixedly connected to said support surface.

18. The ultrasonic cutting machine of claim 11 wherein the basin is fixedly connected to said support surface by one or more mechanical fasteners.

19. The ultrasonic cutting machine of claim 11 wherein the cleaning surface is fixedly connected to the basin.

20. The ultrasonic cutting machine of claim 11 wherein the cleaning surface is fixedly connected to the basin by one or more mechanical fasteners.

* * * * *